US005549792A

United States Patent [19]

Begemann et al.

[11] Patent Number: 5,549,792

[45] Date of Patent: Aug. 27, 1996

[54] HEADBOX FOR A PAPER MACHINE

[75] Inventors: Ulrich Begemann, Leonberg; Helmut Heinzmann, Röhmenkirch; Wolfgang Ruf, Heidenheim; Dieter Egelhof, Heidenheim; Gernot Kinzler, Heidenheim, all of Germany

[73] Assignee: J. M. Voith GmbH, Germany

[21] Appl. No.: 273,903

[22] Filed: Jul. 12, 1994

[30] Foreign Application Priority Data

Jul. 12, 1993 [DE] Germany ..... 43 23 263.9

[51] Int. Cl.[6] ..... D21F 1/06

[52] U.S. Cl. ..... 162/216; 162/336; 162/338; 162/343

[58] Field of Search ..... 162/216, 336, 162/337, 338, 343; 366/160, 150, 184, 134

[56] References Cited

U.S. PATENT DOCUMENTS

| | | | |
|---|---|---|---|
| 4,897,160 | 1/1990 | Wolf et al. | 162/343 |
| 4,898,643 | 2/1990 | Weisshuhn et al. | 162/259 |
| 4,909,904 | 3/1990 | Kinzler | 162/343 |
| 5,196,091 | 3/1993 | Hergert | 162/258 |
| 5,316,383 | 5/1994 | Begemann et al. | 366/160 |

FOREIGN PATENT DOCUMENTS

| | | |
|---|---|---|
| 3514554 | 3/1986 | Germany . |
| 9205111 | 6/1992 | Germany . |

*Primary Examiner*—Donald E. Czaja
*Assistant Examiner*—Calvin Padgett
*Attorney, Agent, or Firm*—Ostrolenk, Faber, Gerb & Soffen, LLP

[57] ABSTRACT

A headbox for a paper machine is characterized by having: at least one machine-wide channel region which defines a main direction of flow; a region for the production of turbulence; a plurality of feed lines distributed over the machine width and discharging into the headbox channel region; an adjusting device in each feed line for controlling the quantity of flow; an angle α between the main direction of flow and the feed line; and the angle α being selected in such a manner that, regardless of the amount fed by the feed line, the total volumetric flow in the region directly downstream of the feed line remaining constant.

24 Claims, 3 Drawing Sheets

HEADBOX FOR A PAPER MACHINE

BACKGROUND OF THE INVENTION

The present invention relates to a headbox for a paper machine, the headbox having at least one distributor for distributing the pulp suspension over the width of the machine, a turbulence insert for producing microturbulence, and a headbox nozzle for producing a jet of pulp for applying the pulp suspension onto a wire or between two wires.

Headboxes are known, for instance, from the following documents, which are incorporated by reference:

(1) DE 35 14 554 A1

(2) U.S. Pat. No. 4,909,904

(3) U.S. Pat. No. 5,196,091

In document (1) a headbox is shown having a plurality of feed and/or discharge lines distributed over the width of the machine by which pulp suspension can be withdrawn from the headbox or whitewater can be introduced into the headbox. No detailed information is given in that document as to the manner in which the lines are arranged or, in particular, their angle with respect to the direction of pulp or water flow at the corresponding place in the headbox.

Document (2) also shows a headbox into which dilution water can be introduced, distributed over the width of the machine in front of the turbulence insert, by means of a plurality of tubes. This document emphasizes that the dilution water is introduced parallel to the main direction of flow at the corresponding point of the headbox.

Document (3) also shows a headbox into which dilution water is introduced through a plurality of feed lines, emphasis being placed in this document on the fact that the introduction of the dilution water is effected perpendicular to the direction of flow of the pulp suspension at the corresponding place, and furthermore on the fact that the dilution water is introduced directly in front of the turbulence insert.

Experiments have shown that when suspension or dilution water is introduced into the headbox as disclosed in these documents, e.g. document (3), restricted cross-sections, providing very high resistances to flow, are required to be arranged behind the place of introduction, in order to prevent the introduced suspension or dilution water from disturbing the cross-machine profile of the fiber orientation when correcting the transverse profile of the basis weight.

SUMMARY OF THE INVENTION

The object of the present invention is accordingly to provide a headbox which, on the one hand, can be operated at favorable cost, i.e. without a great loss of pressure, while, on the other hand, the headbox can exert a specific, desired influence on the transverse (cross-machine) profile of the basis weight, and the transverse profile of the fiber orientation, without also influencing the other parameter. This object may be achieved by the features set forth and claimed herein.

The inventors have discovered that:

1. If the basis weight of the web of paper is to be controlled by means of the headbox at a specific location over the width of the machine without simultaneous disturbance of the transverse profile of the fiber orientation, by controlling the concentration of pulp at the corresponding point of the headbox, it is necessary to feed pulp suspension having a concentration different from the main stream at the corresponding point and, at the same time, to reduce by the same amount the volume of the main flow. This can be done by setting the angle at which the jet feeds the pulp into the headbox such that, on the one hand, it blocks the passing main stream of pulp suspension only by the amount of new volume which it itself introduces into the main stream; while, on the other hand, it adds no additional momentum or acceleration into the main stream.

In general, when combining a main flow with a secondary flow, the resulting combined flow may be influenced by the angle at which the secondary flow merges into the main flow.

Normally, the combined flow will be greater than the main flow. However, in known headboxes, for example, if a jet enters in a direction perpendicular or opposite to the direction of main flow, it produces at the entry point a reduction of the flow, as a result of which a depression (loss of pressure) is produced in the headbox, which leads to a disturbance in the orientation of the fiber at the entry point, and also in the adjacent regions due to the resultant compensatory flow. This is attributable to an increase in turbulence at the point of mixing.

The opposite effect is obtained by a parallel addition of pulp suspension. In that case, an additional momentum is imparted to the main flow, i.e. the speed of the flow increases in this region.

2. If the above findings (1) are applied, it is possible, by deliberate application of this flow mechanism, to produce a flow increase and/or a decrease as desired at any desired place in the headbox. If a pulp suspension having a concentration which corresponds to the concentration of the main stream is used for the production of this increase and/or decrease, then the fiber orientation can be controlled as desired in this way, without at the same time affecting the cross-sectional profile of the basis weight or, if this is not entirely possible, in case the fiber orientation, basis weight, or cross profile are not as they should be, these parameters may be corrected by adjusting the concentration of the introduced partial suspension stream.

If the basis weight of the paper web is to be controlled at a given location (over the width of the paper web), then the concentration (in terms of the weight of the fibers per liter of suspension) should be different from the concentration in the main flow. If it is desired at the same time to maintain the main flow at a constant level, after the introduction of the secondary flow, then the angle of introduction should be adjusted.

In response to an irregularity in basis weight over the width of the paper web (i.e., in the cross-machine direction) it may only be necessary to adjust one or a few of the feed lines, rather than all of the lines in a given row.

By suitable meaningful combinations of the above-indicated mechanisms a headbox can thus be constructed which is optimally equipped and enabled for adjusting the transverse profile of the basis weight and the transverse profile of the fiber orientation.

It is not possible to indicate a universally valid angle for feeding a secondary suspension stream into the main suspension stream within the headbox which is valid in all cases, since the corresponding optimal angle at which the introduction of a secondary stream does not result in any change in the main stream depends on the specific geometrical conditions in the immediate vicinity of the place of introduction.

Other features and advantages of the present invention will become apparent from the following description of examples of the invention with reference to the accompanying drawings.

DETAILED DESCRIPTION OF EMBODIMENTS OF THE INVENTION

Figure 1:
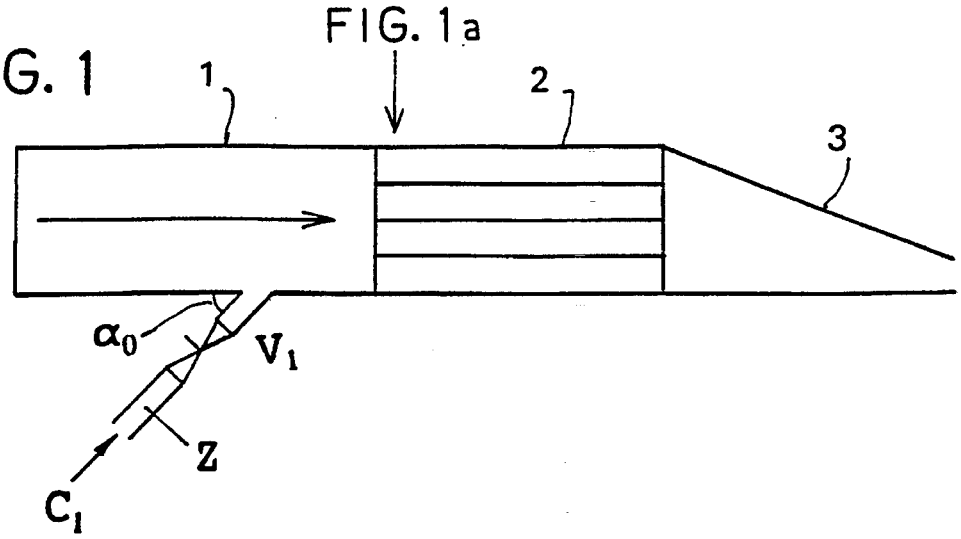
FIG. 1 is a schematic cross-sectional view of a headbox with a row of feed lines for adding additional pulp suspension to the headbox in the distribution region.
Figure 6:
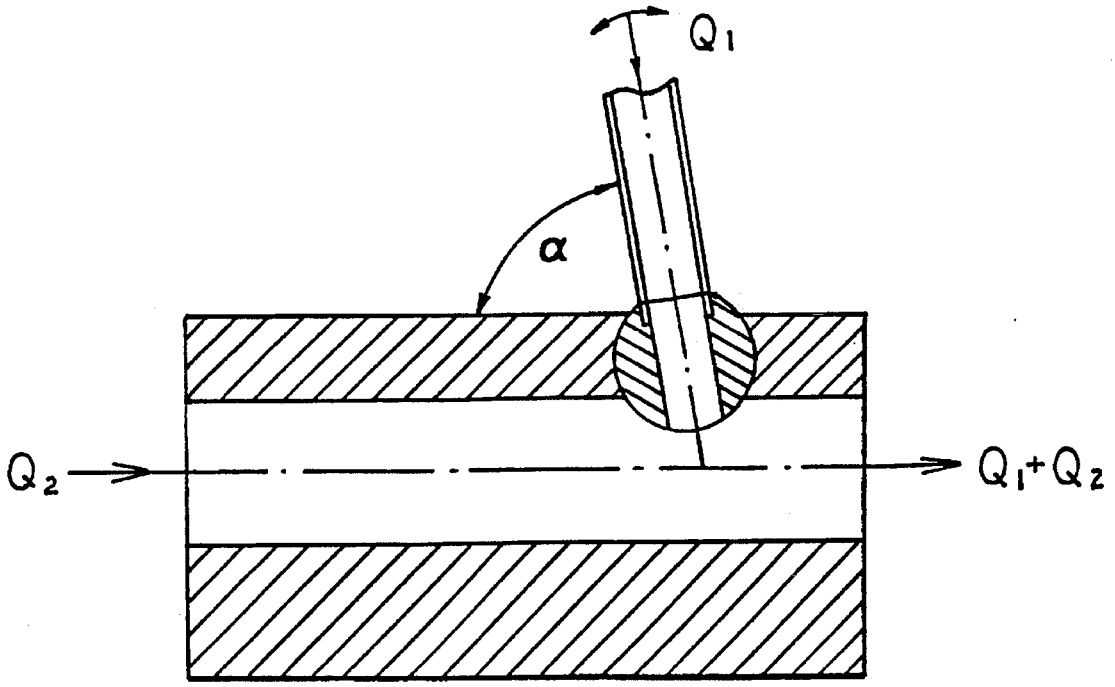
FIG. 6 is a detail view of a feed line showing a device for adjusting its angle.

FIG. 1 shows schematically a headbox having a prechamber 1 in which the direction of the main flow of the pulp suspension is indicated by an arrow, a turbulence insert 2 adjoining it, followed by an outlet nozzle 3. In accordance with this embodiment of the invention, a plurality of feed lines Z, arranged in a row across the headbox (only one being shown here), are fed into this headbox in the region of the prechamber 1 at an angle $\alpha_0$, $\alpha_0$ being the angle at which no change takes place in the volume of flow in the direction of the main stream despite the additional introduction of fluid. This angle may be adjusted, for example, by a pivotable mounting device as shown in FIG. 6. In this way, by feeding whitewater having a pulp concentration of $C_1$ while at the same time regulating the volume of the stream fed via the valve $V_1$, the transverse profile of the basis weight can be adjusted without affecting the orientation of the fiber.

Figure 1A:
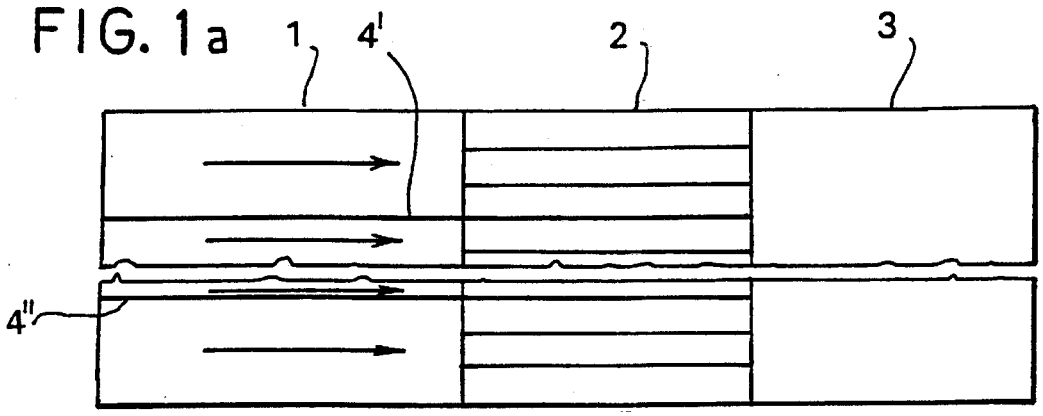
FIG. 1*a* corresponds to a plan view of the headbox of FIG. 1 and shows alternate embodiments which may include partitions which divide the headbox width-wise into channels.

FIG. 1*a* is a view from above, in very stylized fashion, of the headbox of FIG. 1, illustrating the presence of partitions, which effectively divide the flow into channels. As examples, two possible partition constructions 4' and 4"are shown in FIG. 1*a*. The partition 4' extends from the prechamber entrance up to the turbulence insert; while the partition 4" extends from the prechamber entrance toward the turbulence insert through part of the prechamber 1.

Figure 2:
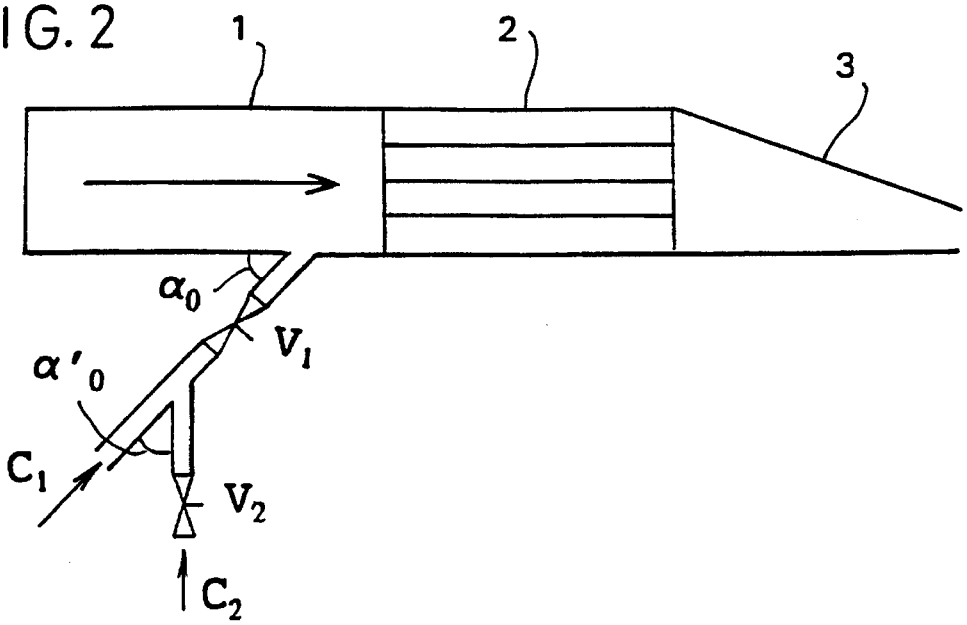
FIG. 2 shows a headbox similar to FIG. 1, with a modified valve arrangement on the feed lines.

FIG. 2 shows a headbox which corresponds to FIG. 1, but differs from it in that the feed lines in front of the valve $V_1$ are fed, in turn, with different concentrations $C_1$ and $C_2$ by two feed lines, the joinder angle $\alpha'_0$ of the respective feed lines having the concentrations $C_1$ and $C_2$ being so selected that the total volumetric flow of the feed line can be adjusted by the valve $V_1$, and the density of the pulp by the valve $V_2$. Opening or closing of the valve $V_2$ does not affect the total feed stream. In other words, the properties of a mixing valve shown in German Utility Model G 92 05 111.1 (incorporated by reference) are employed here.

Figure 3:
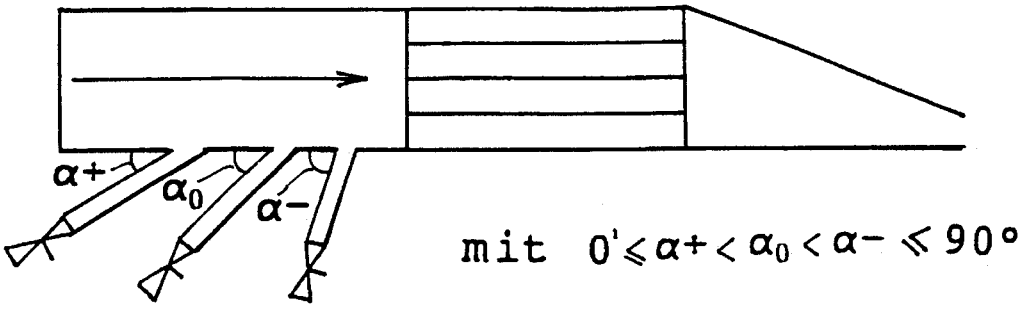
FIG. 3 shows another embodiment of a headbox, having a plurality of rows of feed lines in the distribution region.

FIG. 3 shows a further possible combination of feed lines for feeding secondary streams into the main stream of the headbox, a number of rows of feed lines connected one behind the other being provided in this embodiment of the invention. The three rows of feed lines, as shown in this example, form angles which result respectively in an increase in the total volumetric flow of the corresponding section ($\alpha^+$), in a constant total volumetric flow ($\alpha_0$), or else in a reduction in the total volumetric flow ($\alpha^-$). As explained above, only one or a few of the feed lines in a particular row may be used, in order to provide a flow correction at a specific location within the width of the paper web. As a result of this arrangement, in accordance with the technique described above, either the transverse profile of the basis weight or the transverse profile of the fiber orientation can be adjusted without affecting the other parameter.

Figure 4:
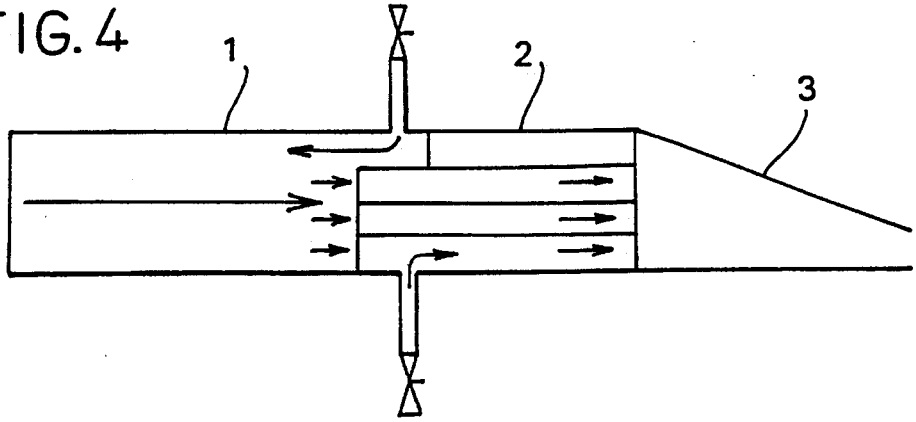
FIG. 4 shows a further embodiment with a different arrangement of feed lines.
Figure 5:
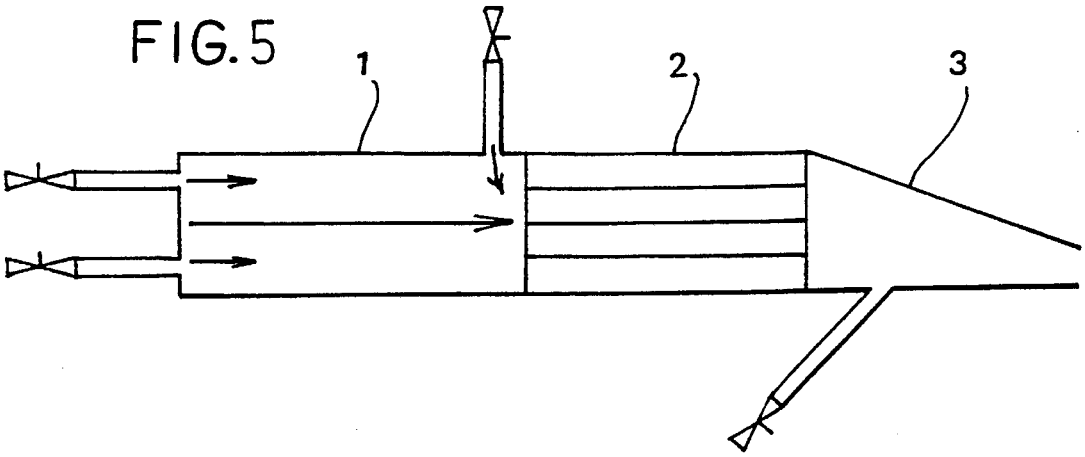
FIG. 5 shows an embodiment with yet another arrangement of feed lines.

FIGS. 4 and 5 show further embodiments of the invention. Those figures show, e.g., that introduction of a partial volume flow into the headbox at an angle of 90° is also possible. The upper horizontal arrow in FIG. 4 indicates that there is a reverse flow, due to a divider in the turbulence region just after the entrance of the feed line coming from above. Providing a return flow is thus an additional means of influencing the flow conditions inside the headbox.

The long arrow in FIGS. 4 and 5 indicates the main flow direction; the short arrows indicate partial volume flows coming out from the feed lines (in FIG. 5) and respectively entering the turbulence portion (in FIG. 4).

In accordance with the invention, it is possible, of course, not only to connect the feed lines to the top and bottom sides of the headbox, but also to feed suspension into the side walls or directly into the turbulence tubes of the turbulence insert.

The use of feed lines of different diameters in order to control the speed of entrance of suspension into the headbox with a given throughput also falls within the scope of the invention.

Furthermore, it is also possible in line with the invention, in the case of a multi-layer headbox, to apply the features described above specifically to a single layer or simultaneously to several layers. A multi-layer headbox may, for example, be divided by at least one partition which extends in the flow direction and extends across the entire width of the headbox to separate the layers from each other.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

What is claimed is:

1. A headbox for a paper machine, comprising:

at least one channel region defining a main direction of flow for a fiber suspension and extending over the width of the paper machine;

a region in which turbulence is produced in the suspension;

a region comprising an outlet nozzle region for the headbox;

a plurality of feed lines for introducing an auxiliary fluid flow into the headbox distributed over the width of the machine, and discharging into the outlet nozzle region; and an adjusting device for controlling the quantity of said auxiliary flow in each said feed line;

each feed line defining an angle $\alpha$ between the main direction of flow and the feed line; and the angle $\alpha$ being selected so that, regardless of the amount of auxiliary flow fed through the feed line, total volumetric flow in the headbox immediately downstream of the feed line remains constant.

2. A headbox according to claim 1, wherein said channel region is divided with respect to the width of the headbox by at least one partition which extends in the direction of flow.

3. A headbox according to either of claims 1 and 2, wherein the angle $\alpha$ differs by between 5° and 85° from a perpendicular angle to the direction of flow of the main stream.

4. A headbox for a paper machine, comprising:

at least one channel region defining a main direction of flow for a fiber suspension and extending over the width of the paper machine;

a region in which turbulence is produced in the suspension;

a region which serves as an outlet nozzle for the headbox;

a plurality of feed lines for introducing an auxiliary fluid flow into the headbox distributed over the width of the machine, and discharging into the headbox; and an adjusting device for controlling the quantity of said auxiliary flow in each said feed line;

each feed line defining an angle $\alpha$ between the direction of the main stream and the feed line;

at least two rows of feed lines being provided, arranged one behind the other, with respect to the direction of the main stream, an insertion angle $\alpha_i$ of an upstream row i differing from an insertion angle $\alpha_j$ of a downstream row j.

5. A headbox according to claim 4, wherein exactly two rows of feed lines are provided, and an insertion angle $\alpha_1$ of the upstream row is greater than an insertion angle $\alpha_2$ of the downstream row.

6. A headbox according to claim 4, wherein exactly two rows of feed channels are provided, and an insertion angle $\alpha_1$ of the upstream row is less than an insertion angle $\alpha_2$ of the downstream row.

7. A headbox according to claim 4, wherein exactly three rows of feed channels are provided, and an insertion angle $\alpha_i$ of one row is greater than an angle $\alpha_0$, said angle $\alpha_0$ being that angle with which no change in total volumetric flow is caused by the corresponding feed line;

an angle $\alpha_j$ of another row is smaller than the angle $\alpha_0$; and an angle $\alpha_k$ of a third row is equal to the angle $\alpha_0$.

8. A headbox according to claim 4, wherein at least one feed line is movable so as to adjust the corresponding angles $\alpha$.

9. A headbox according to claim 4, wherein the feed lines discharge in the machine-wide channel region.

10. A headbox according to claim 4, wherein the feed lines discharge in the outlet nozzle region.

11. A headbox according to claim 4, wherein the feed lines discharge into an upstream end of the machine-wide channel region of the headbox.

12. A headbox according to claim 4, wherein the turbulence-producing region has a plurality of channels or tubes for producing turbulence, and at least some of the feed lines discharge into the turbulence-producing region.

13. A method for controlling the flow of pulp suspension in a selected longitudinal section defined within the overall width of a headbox, the headbox having an outlet nozzle region, the method comprising the steps of:

introducing liquid through nozzles at a plurality of points across the width of the outlet nozzle region of the headbox and into a main stream of the headbox at an angle $\alpha$ to a direction of flow of the main stream; and selecting the angle $\alpha$ with respect to the plane of the main flow such that for a desired change in the basis weight in said selected section:

(a) the angle $\alpha$ is equal to an angle $\alpha_0$ at which no change in total volumetric flow takes place in the headbox in the region directly following the place of introduction in the direction of flow; and (b) the concentration of the suspension liquid introduced and the amount introduced gives, in combination with the main flow, the desired change in basis weight in said selected section.

14. A method for the control of the flow of pulp suspension of a headbox, comprising the steps of:

introducing liquid at a plurality of points into the main stream of the headbox at an angle $\alpha$ to the direction of the main flow;

selecting the angle $\alpha$ with respect to the plane of the main flow such that:

(a) for a desired increase in volume flow, the angle $\alpha$ selected is $\alpha=\alpha_+>\alpha_0$, said angle $\alpha_0$ being that angle with which no change in the total volumetric flow is caused by the corresponding feed line; and (b) for a desired reduction of volumetric flow, the angle selected is a $\alpha=\alpha<\alpha_0$.

15. A method for the control of the flow of pulp suspension of a headbox, comprising the steps of:

(a) introducing liquid into the main stream of the headbox at an angle $\alpha$ to the direction of the main flow;

(b) selecting the angle $\alpha$ with respect to the plane of the main flow such that for a desired change in the basis weight, (b)(1) the angle $\alpha$ is equal to an angle $\alpha_0$ at which no change in total volumetric flow takes place in the headbox in the region directly following in the direction of flow; and (b)(2) the concentration of the suspension liquid introduced and the amount introduced are selected, in combination with the main flow, to give the desired change in basis weight; and (c) selecting the angle $\alpha$ with respect to the plane of the main flow such that:

(c)(1) for a desired sectional increase in volumetric flow, the angle $\alpha$ is selected as $\alpha=\alpha_+>\alpha_0$; and (c)(2) for a desired sectional reduction of volumetric flow, the angle $\alpha$ selected is $\alpha=\alpha<\alpha_0$.

16. A method according to claim 15, wherein a plurality of places of introduction of different angles $\alpha$ are arranged one behind the other with respect to the flow direction of the main stream.

17. A method according to claim 16, wherein the liquid is introduced at a selected location within the width of the headbox so as to control the flow within a longitudinal section which includes said location.

18. A method according to claim 15, wherein the liquid is introduced at a selected location within the width of the headbox so as to control the flow within a longitudinal section which includes said location.

19. A method for the control of the flow of pulp suspension of a headbox, comprising the steps of:

introducing liquid at a plurality of points into a main stream of the headbox at an angle $\alpha$ to the direction of main flow;

the angle $\alpha$ being selected with respect to the plane of the main flow so that for a desired sectional change in the basis weight, the angle $\alpha$ is equal to an angle $\alpha_0$ at which no change in total volumetric flow takes place in the headbox in the region of the place of entrance directly following in the direction of flow; and the liquid being introduced at places of introduction of different angles which are arranged separated from each other with respect to the flow direction of the main stream.

20. A method according to claim 19, further comprising the step of adjusting the concentration of at least one of the introduced liquid streams.

21. A method according to claim 19, wherein the addition of liquid takes place at least in part directly into channels or tubes of a turbulence insert of the headbox.

22. A method according to claim 19, wherein the addition of liquid takes place at least partially into a machine-wide channel region of the headbox.

23. A method according to claim 19, wherein the addition of liquid takes place both into a machine-wide channel region and directly into channels or tubes of a turbulence insert of the headbox.

24. A method according to claim 19, wherein the liquid is introduced by at least one feed line which in turn is fed by at least two lines which are supplied with pulp suspension of different densities and quantities.

* * * * *